United States Patent [19]

Guglia et al.

[11] 4,112,984

[45] Sep. 12, 1978

[54] CAPPED FUEL TANK FUNNEL

[76] Inventors: Gaston Guglia, 10,227 de la Roche St., Montreal; Jacques Lupien, 744 Camille St., Fabreville (Laval), both of Canada

[21] Appl. No.: 819,611

[22] Filed: Jul. 26, 1977

[51] Int. Cl.[2] ..... B65B 39/04; B67C 11/02

[52] U.S. Cl. ..... 141/98; 141/339; 220/4 A; 220/371; 220/372

[58] Field of Search ..... 123/198 R; 141/98, 199–205, 141/297–300, 325, 326, 331–345, 383, 392; 215/308; 222/192; 220/DIG. 19, 366, 371–373, 4 A

[56] References Cited

U.S. PATENT DOCUMENTS

| | | | |
|---|---|---|---|
| 573,333 | 12/1896 | Krimmel | 141/339 X |
| 1,134,837 | 4/1915 | Fox | 141/331 X |
| 3,961,724 | 6/1976 | Kapsy | 220/371 |
| 3,986,538 | 10/1976 | Sather | 141/332 |

*Primary Examiner*—Richard E. Aegerter
*Assistant Examiner*—Frederick R. Schmidt

[57] ABSTRACT

A funnel adapted to be screwed to the filling opening of the fuel tank of snowblowers, lawn mowers, outboard motors and the like engine-operated equipment. The funnel is provided with a cap, in turn having an air intake opening with an air filter. The funnel is thus always accessible for filling the tank.

1 Claim, 5 Drawing Figures

CAPPED FUEL TANK FUNNEL

This invention has to do with a new type of funnel for filling the fuel tanks of combustion driven machinery such as, for example, snowmobiles, snow blowers, garden equipment, lawn mowers and outboard motors. The tanks of such machines can be of very small capacity and thus the opening is also small, necessitating a funnel.

Funnels are easily displaced objects and may not always be available when required as they might be used elsewhere or might simply be misplaced or even lost. The present invention deals with the inconvenience of regular funnels and small capacity fuel tanks by combining the funnel concept with a tank cap in an original way.

It is an object of the present invention to provide a funnel adaptable to all mobile machinery fuel tanks which screws on to the tank opening permanently and which includes a cap to prevent loss of fuel.

It is a second object of the present invention to provide a capped funnel which can be easily screwed on to any sized fuel tank opening by means of an internally and externally threaded insert.

These objects are accomplished in accordance with the preferred embodiment of the invention by means of a funnel including an internally threaded extended base and a detachable cap. The extended integral base of the funnel is adapted to receive, by means of its threading, screw-on inserts which fit onto fuel tank openings of various sizes.

The preferred embodiment of the invention is illustrated in the accompanying drawings in which FIG. 1 is a perspective view of the funnel with the cap attached.

Figure 3:
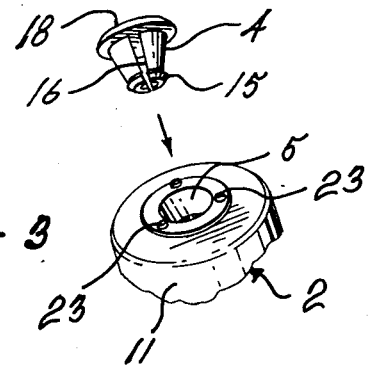
FIG. 3 is an exploded perspective view of the top of the cap and of the air plug.
Figure 4:
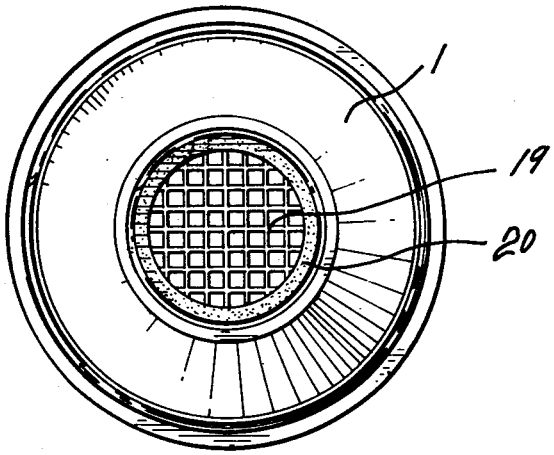
FIG. 4 is a bottom view of the funnel.
Figure 5:
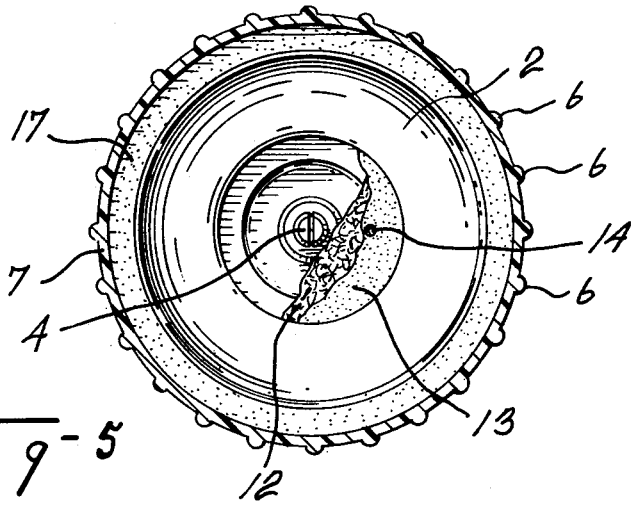
FIG. 5 is a cross-sectional view of the cap looking up and taken along line 5—5 of FIG. 2 including a partial cut-away view of the air filter.

In the drawings, like elements are designated by like reference numerals. The capped fuel tank funnel of the present invention includes a funnel 1 having an integrally moulded cylindrical extension 3 extending downward from the smaller circumference opening of said funnel 1, a cap 2 provided with detachable means therewith, and a removable air-inlet plug 4 which fits into a tapered hole 5 of cap 2 as shown in FIG. 3. The cap 2 has a vertical flange 7 whose outside perimeter is equipped with integrally moulded raised ribs 6 in parallel spaced-apart relationship in order to assure a good grip when detaching said cap 2. The inside surface of said flange 7 is provided with threading 8 which meshes snugly with the complementary thread 9 integrally moulded on the outside surface of the top vertical cylindrical section 10 of said funnel 1. Cap 2 attaches to the larger circumference opening of funnel 1 at the top of said funnel 1.

Cap 2 is provided inside its round top projection 11, with an air-filter 12 composed of open-cell foam or other suitable material. Keeping said filter 12 in place a retaining round wafer 13 of suitable material is push-fitted into place underneath said air filter 12 and serves to protect the air filter from upwardly spraying fuel. Said wafer 13 has small perforations 14 to permit air passage. Immediately above said air filter 12, the air plug 4 snaps into place in the hole 5 by means of a lip 15 which engages the bottom edge of said hole 5. Said plug 5 is provided with a slit 16 thus allowing easy air intake. A hat 18 on said plug insures that no water or foreign matter will enter the funnal. Hat 18 rests on buttons 23 protruding from projection 11 to further insure a free air passage.

The lower or smaller-circumference end of said funnel 1 is provided with an integrally moulded or wire-mesh 19 which acts therein as a coarse fuel filter. An annular gasket 17, of suitable material, is located inside the cap at the top of said vertical flange 7 to prevent fuel spillage.

Underneath said mesh 19, and adjacent thereto is a second annular gasket 20 provided for leak-proof installation of the invention on a fuel tank opening.

Figure 1:
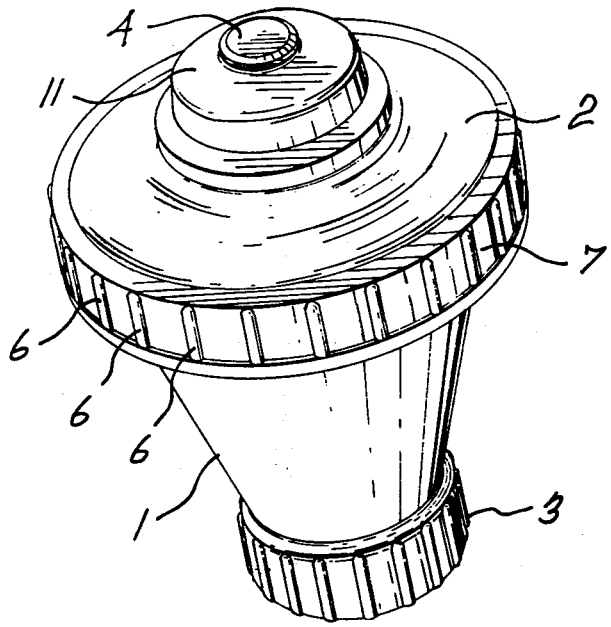
Figure 2:
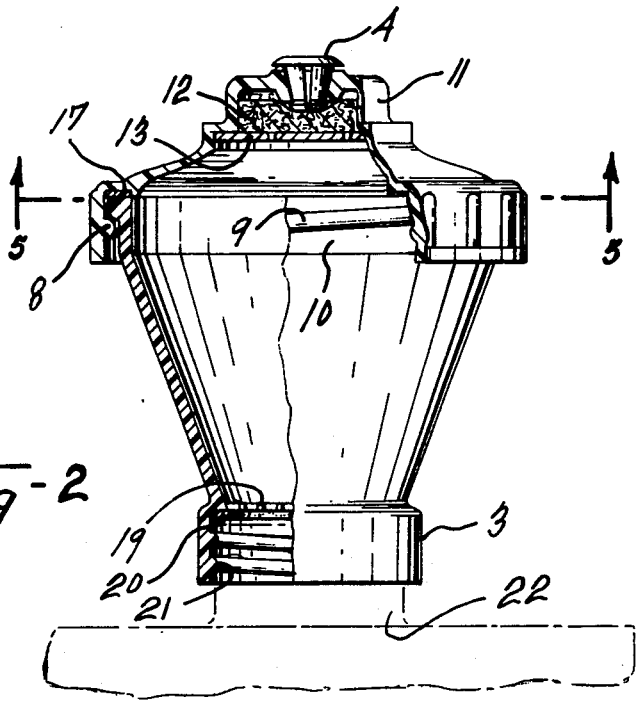
FIG. 2 is a side view, partially in section, of the capped funnel in position over the opening of a fuel tank.

The cylindrical extension 3 of funnel 1 is provided with internal threading 21 to detachably secure said funnel onto the externally threaded cylindrical neck 22 of a fuel tank filling opening, as shown in FIG. 2.

To fill the fuel tank, only cap 2 needs to be removed; it is then screwed back to prevent fuel spilling.

What we claim is:

1. A funnel for attachment to the externally threaded neck of the filling opening of the fuel tank of an engine-operated machine, such as a lawn-mower, snowblower or the like, such funnel comprising a funnel body, made of molded plastic and having a large circumference upper end and a small circumference lower end, said lower end being provided with an integrally formed first cylindrical extension having internal threads and a sealing gasket for fluid-tight detachably securing said funnel body onto the externally threaded cylindrical neck of the fuel tank filling opening, said upper end being provided with an integral second cylindrical extension having external threads, a detachable cap provided with a depending cylindrical skirt having a sealing gasket and internal threads complementary to the threads of said second cylindrical extension for fluid-tight and detachable connection of said cap to said funnel body, said cap having a central round top projection forming an upper external surface and having a tapered air inlet hole, said projection having buttons at its top external surface closely surrounding said hole, an air inlet hole plug having a tapered body fitted within said hole having a hat-shape top forming a rigidly protruding flange resting on said buttons and maintained spaced from said top external surface, said tapered body being provided with a slit permitting air intake into said funnel body, said plug body being further provided with a lip at its inner smaller diameter end engaging the inner surface of said projection and maintaining said air inlet plug in position within said tapered hole, said plug allowing air to enter within said funnel body while substantially excluding water from entrance within said funnel body, an air filter, of open-cell foam, located within said projection below said plug and a perforated wafer located at the base of said projection below said air filter supporting the same and preventing upwardly splashing fuel from reaching said air filter.

* * * * *